US011896151B2

(12) United States Patent
Myrick

(10) Patent No.: US 11,896,151 B2
(45) Date of Patent: Feb. 13, 2024

(54) SECURED PARCEL DELIVERY SYSTEM

(71) Applicant: Laurence Myrick, Oklahoma City, OK (US)

(72) Inventor: Laurence Myrick, Oklahoma City, OK (US)

( * ) Notice: Subject to any disclaimer, the term of this patent is extended or adjusted under 35 U.S.C. 154(b) by 468 days.

(21) Appl. No.: 17/219,941

(22) Filed: Apr. 1, 2021

(65) Prior Publication Data

US 2022/0312999 A1 Oct. 6, 2022

(51) Int. Cl.

*A47G 29/22* (2006.01)
*A47G 29/30* (2006.01)
*A47G 29/14* (2006.01)

(52) U.S. Cl.

CPC ..... *A47G 29/22* (2013.01); *A47G 29/141* (2013.01); *A47G 29/30* (2013.01); *A47G 2029/149* (2013.01)

(58) Field of Classification Search

CPC ..... A47G 29/22; A47G 29/28; A47G 29/30; A47G 29/141; A47G 2029/149; A47G 2029/145; E06B 7/32; E05G 7/00
USPC ..... 232/43.3
See application file for complete search history.

(56) References Cited

U.S. PATENT DOCUMENTS 5,143,284 A 9/1992 Socarras
5,247,282 A 9/1993 Marshall
6,347,737 B1 2/2002 Madruga
7,182,245 B1 2/2007 Nieto
10,299,617 B1 * 5/2019 Castellanos ..... A47G 29/141
10,743,693 B2 * 8/2020 Newcomb ..... E06B 7/32
10,772,451 B2 * 9/2020 Vernal Silva ..... A47G 29/20
11,278,144 B2 * 3/2022 Vernal Silva ..... A47G 29/141
11,346,150 B1 * 5/2022 Johnston ..... E06B 7/32
2003/0006275 A1 * 1/2003 Gray ..... A47G 29/14 232/19
2004/0256449 A1 * 12/2004 Stagnaro ..... A47G 29/12 232/28
2004/0263029 A1 * 12/2004 Scholefield ..... A47G 29/16 312/242
2007/0170237 A1 7/2007 Neff
2014/0190081 A1 * 7/2014 Wanjohi ..... A47G 29/126 49/504
2016/0247344 A1 * 8/2016 Eichenblatt ..... G07C 9/00896
2017/0286905 A1 * 10/2017 Richardson ..... A47G 29/20
2018/0070753 A1 * 3/2018 Eveloff ..... H04W 4/025
2018/0228310 A1 * 8/2018 Enobakhare ..... A47G 29/20
2019/0180544 A1 * 6/2019 Newcomb ..... E06B 7/32
2019/0248582 A1 * 8/2019 Nevison ..... A47G 29/20
(Continued)

*Primary Examiner* — William L Miller

(57) ABSTRACT

A secured parcel delivery system for creating temporary access through a door for delivered parcels includes a door. The door has a portal aperture which extends therethrough. The portal aperture includes a perimeter edge. A panel is pivotably attached to the perimeter edge. The panel is positionable in an open condition which exposes the portal aperture or in a closed condition which covers the portal aperture. A driver mechanism actuates the panel alternatingly between the open condition and the closed condition. A locking mechanism is attached to and releasably locks the panel when the panel is in the closed condition. The locking mechanism is actuated to an unlocked condition which allows the panel to be moved to the open condition or a locked condition which restrains the panel in the closed condition.

19 Claims, 6 Drawing Sheets

(56) References Cited

U.S. PATENT DOCUMENTS

| | | | | |
|---|---|---|---|---|
| 2019/0261802 | A1* | 8/2019 | Vernal | A47G 29/20 |
| 2019/0316411 | A1* | 10/2019 | Vanek | E06B 7/32 |
| 2020/0071991 | A1* | 3/2020 | Patel | E06B 7/34 |
| 2020/0308903 | A1* | 10/2020 | Anderson | E05F 15/76 |
| 2020/0352376 | A1* | 11/2020 | Vernal Silva | A47G 29/141 |
| 2021/0005033 | A1* | 1/2021 | Roman | G06Q 10/0833 |
| 2021/0038004 | A1* | 2/2021 | Graña Domínguez | A47G 29/141 |
| 2021/0177182 | A1* | 6/2021 | Plummer | A47G 29/28 |
| 2021/0230926 | A1* | 7/2021 | Schler | E05F 15/73 |
| 2022/0031105 | A1* | 2/2022 | Newcomb | G06Q 10/0833 |
| 2022/0039581 | A1* | 2/2022 | Lee | A47G 29/30 |
| 2022/0151419 | A1* | 5/2022 | Lee | G06Q 10/083 |
| 2022/0155005 | A1* | 5/2022 | Lee | G06Q 10/0832 |
| 2023/0043156 | A1* | 2/2023 | Shah | E05C 17/003 |
| 2023/0159286 | A1* | 5/2023 | Schler | E05F 15/77 414/389 |

* cited by examiner

SECURED PARCEL DELIVERY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to parcel delivery securement systems and devices and more particularly pertains to a new parcel delivery securement system for creating temporary access through a door for delivered parcels. A temporary portal through a door allows interior access to a dwelling for delivery parcels. The delivery is verifiable and access remotely granted and remotely restricted.

(2) Description of Related Art Including Information Disclosed Under 37 CFR 1.97 and 1.98

The prior art relates to parcel delivery securement systems and devices. Limiting access to the interior of a delivery area is accomplished by allowing delivery verification prior to deposit and limiting the time the portal is available.

BRIEF SUMMARY OF THE INVENTION

An embodiment of the disclosure meets the needs presented above by generally comprising a door. The door has an exterior surface, an interior surface, and a perimeter wall extending between the exterior surface and the interior surface. The door is mounted in a dwelling wall. The door has a portal aperture which extends therethrough. The portal aperture includes a perimeter edge. The perimeter edge includes a top edge, a bottom edge, a first lateral edge and a second lateral edge. A panel is pivotably attached to the perimeter edge. The panel is positionable in an open condition which exposes the portal aperture or in a closed condition which covers the portal aperture. A driver mechanism is mounted on the door and actuates the panel between the open condition and the closed condition. The driver mechanism has a first element which is mounted to the door and a second element which is mounted to the panel. The driver mechanism moves the panel alternatingly between the open condition and the closed condition. A locking mechanism is attached to and releasably locks the panel in the closed condition. The locking mechanism is actuated to an unlocked condition which allows the panel to be moved to the open condition or a locked condition which restrains the panel in the closed condition. The locking mechanism includes: a first locking component which is mounted on the door, and a second locking component which is mounted on the panel and positioned to mate with the first locking component when the panel is in the closed condition.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
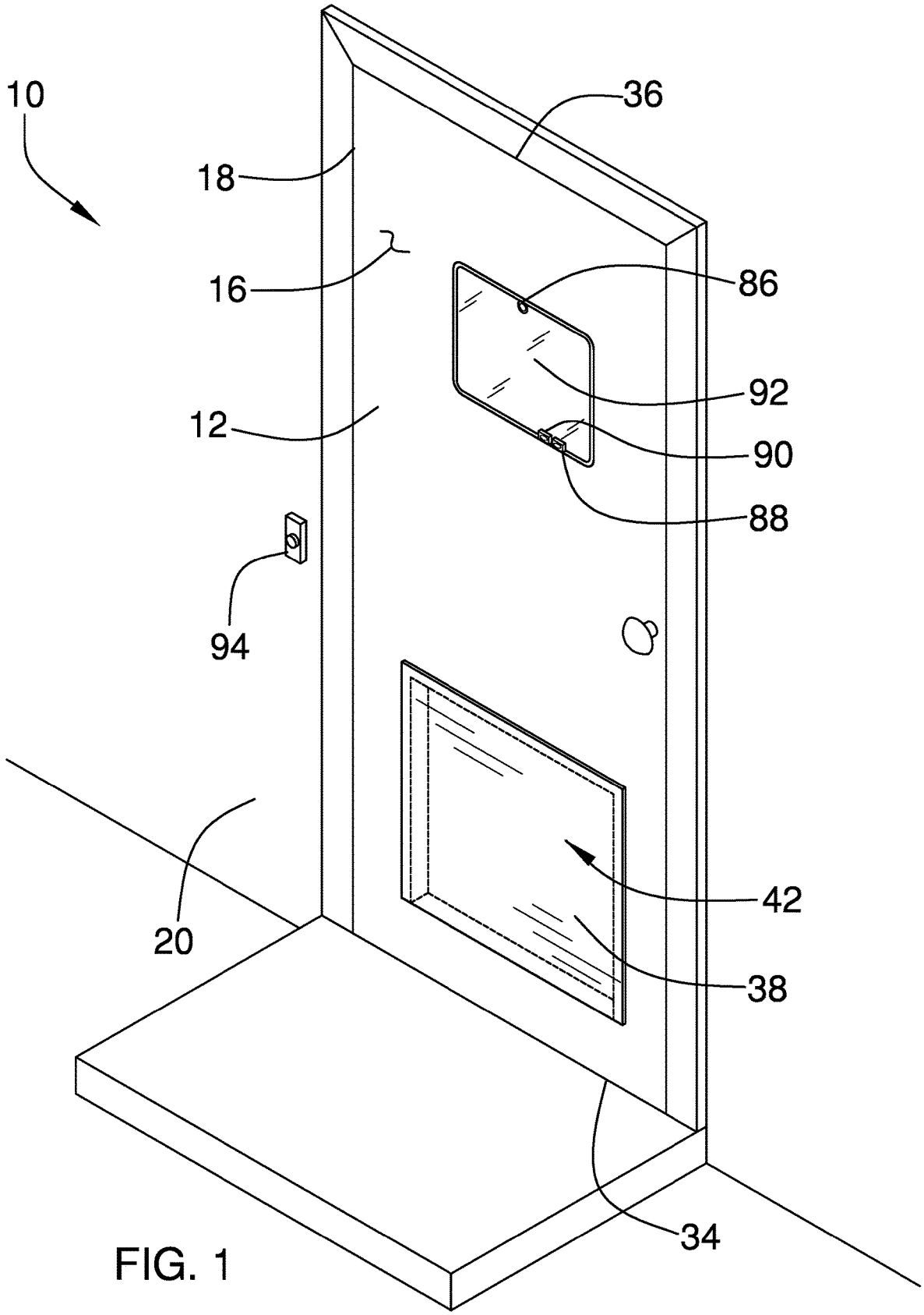
FIG. 1 is a top front isometric in-use view of a secured parcel delivery system according to an embodiment of the disclosure showing the panel in the closed condition.
Figure 2:
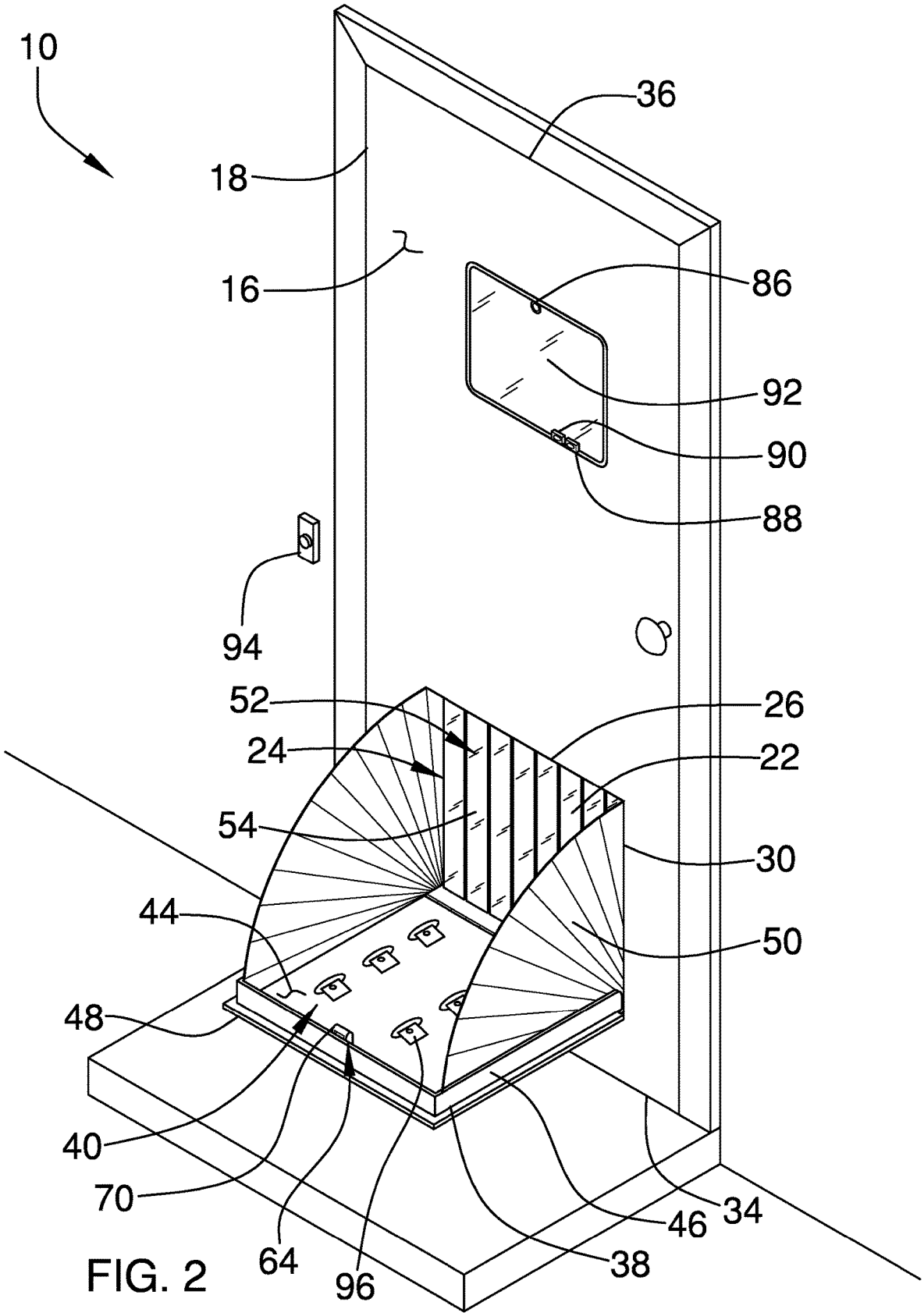
FIG. 2 is a top front isometric in-use view of an embodiment of the disclosure showing the panel in the open condition.
Figure 3:
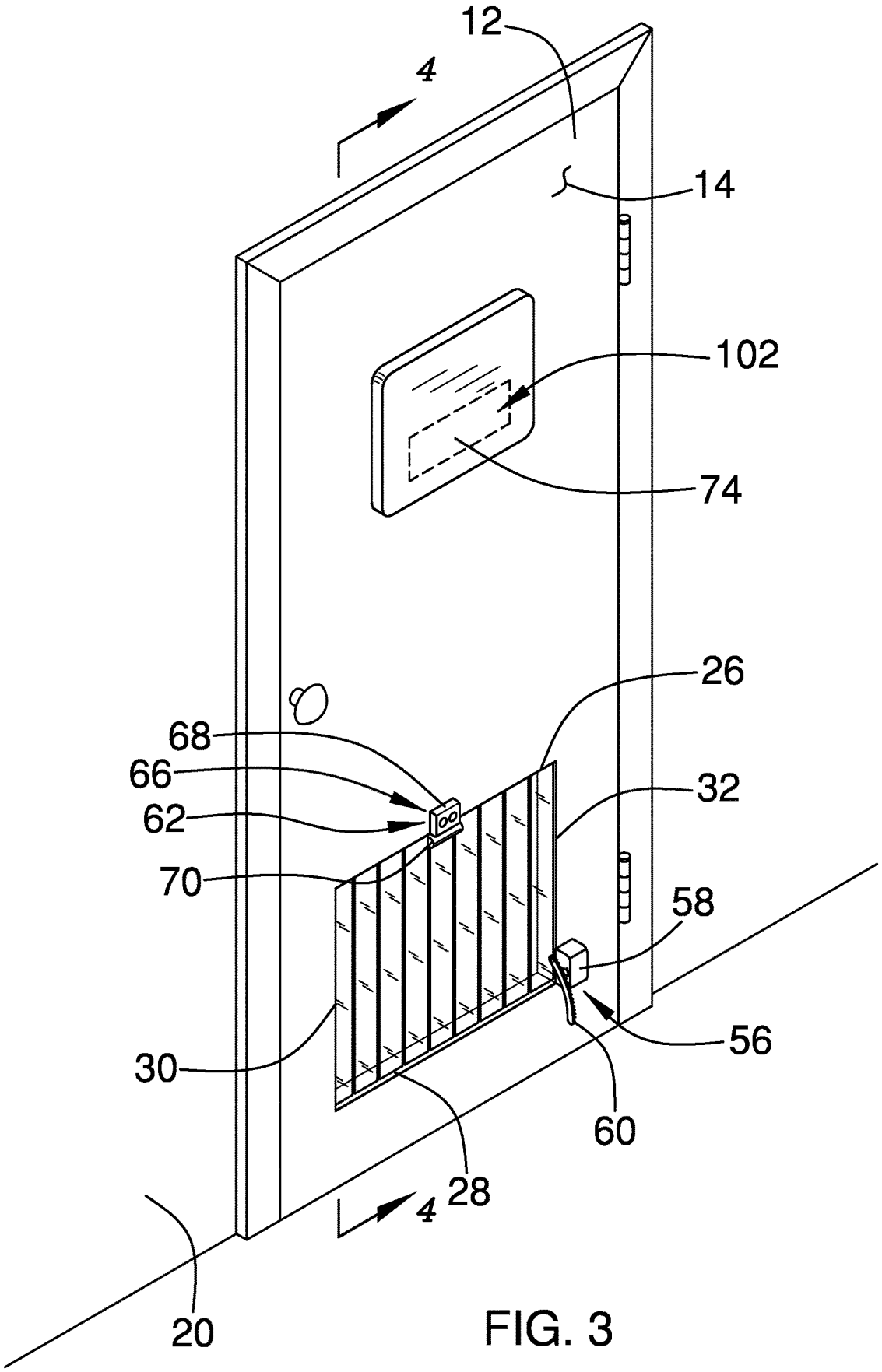
FIG. 3 is a top rear isometric in-use view of an embodiment of the disclosure showing the interior of the door.
Figure 4:
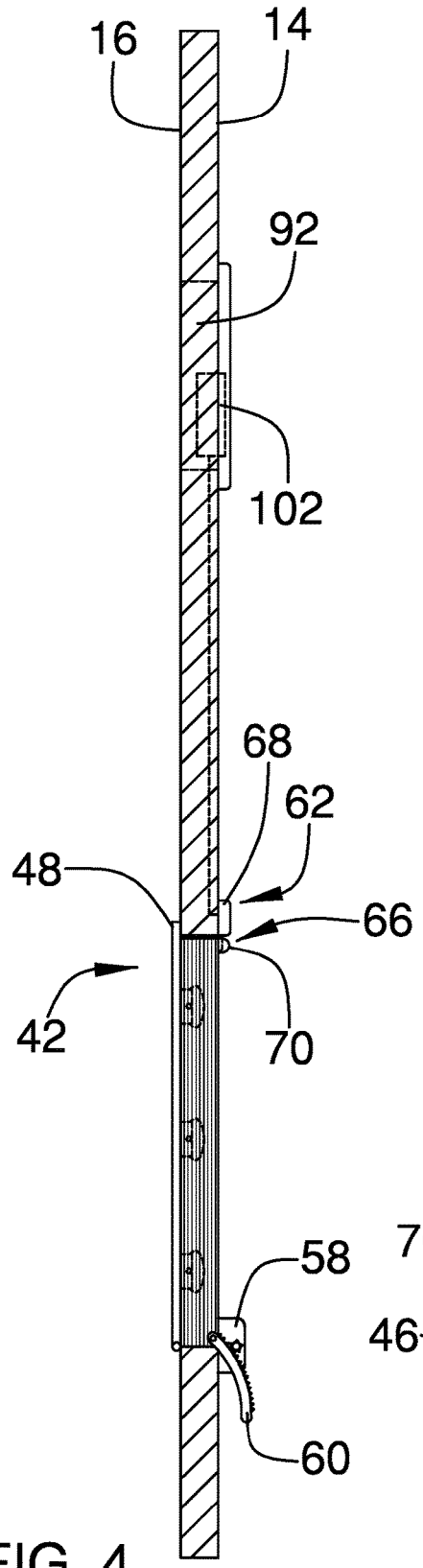
FIG. 4 is a side section view of an embodiment of the disclosure if segmented about line 4-4 in FIG. 3.
Figure 5:
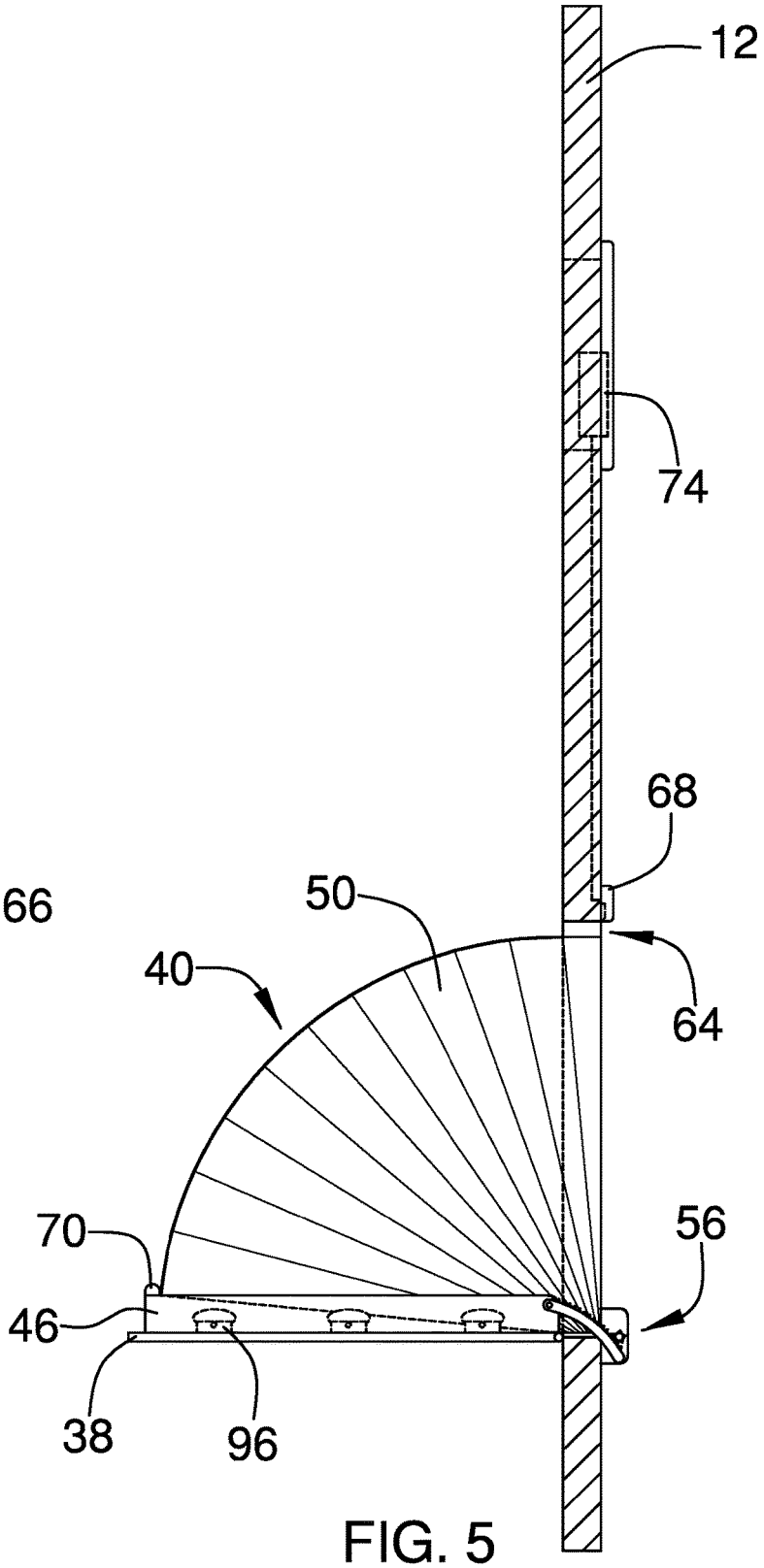
FIG. 5 is a side section view of an embodiment of the disclosure if segmented about line 4-4 in FIG. 3 showing the panel in the open condition.
Figure 6:
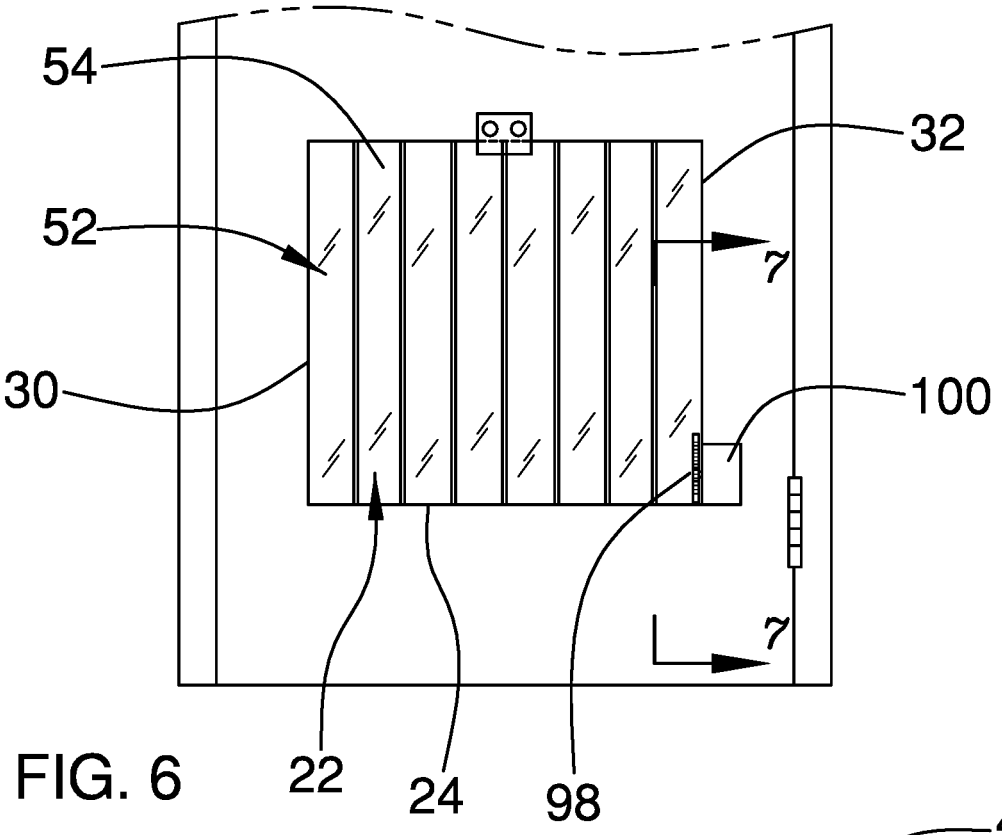
FIG. 6 is a zoomed in front side view of an embodiment of the disclosure showing the mounting of the driver mechanism.
Figure 7:
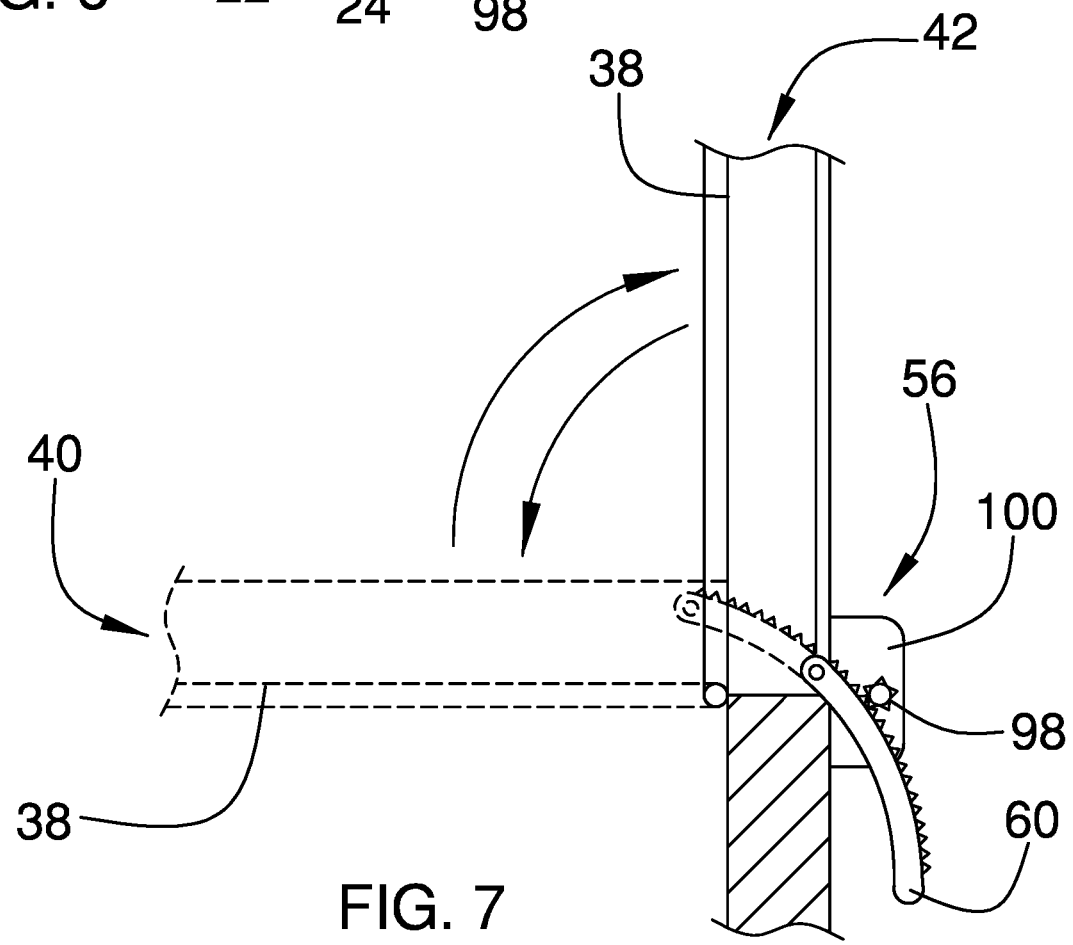
FIG. 7 is a zoomed in side view of an embodiment of the disclosure showing the function of the driver mechanism.
Figure 8:
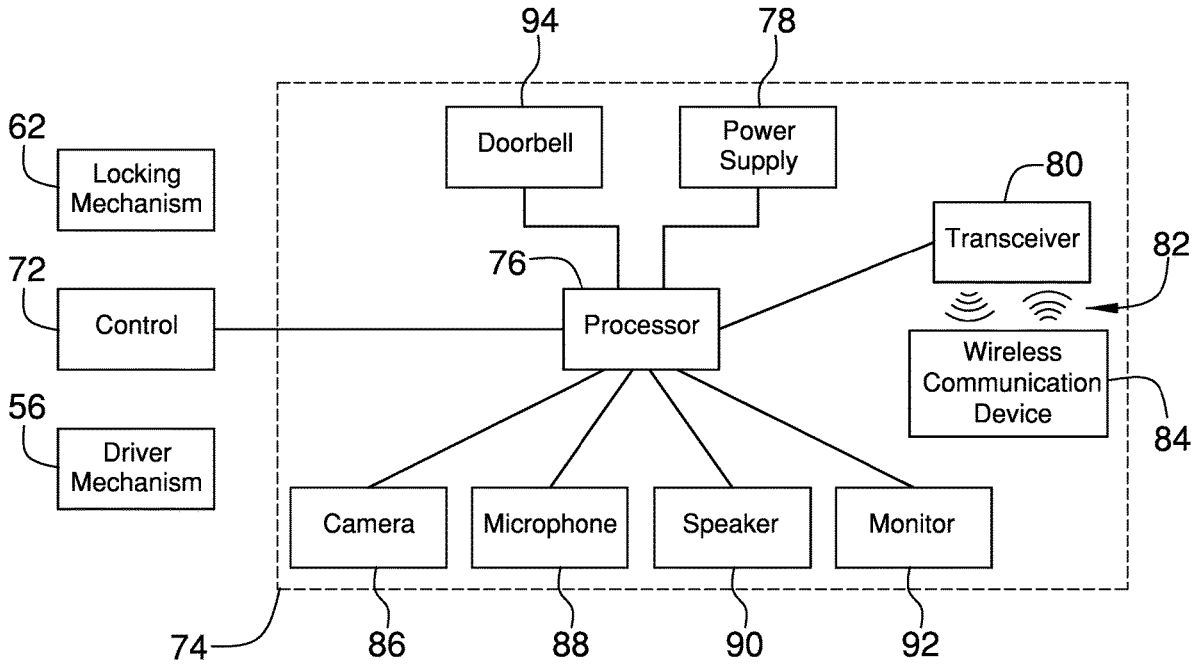
FIG. 8 is a diagram view of the interface in an embodiment of the disclosure.

With reference now to the drawings, and in particular to FIGS. 1 through 8 thereof, a new parcel delivery securement system embodying the principles and concepts of an embodiment of the disclosure and generally designated by the reference numeral 10 will be described.

As best illustrated in FIGS. 1 through 8, the secured parcel delivery system 10 generally comprises a door 12. The door 12 has an exterior surface 14, an interior surface 16, and a perimeter wall 18. The perimeter wall 18 extends between the exterior surface 14 and the interior surface 16. The door 12 is mounted in a dwelling wall 20. The door 12 has a portal aperture 22 extending therethrough. The portal aperture 22 includes a perimeter edge 24. The perimeter edge 24 has a top edge 26, a bottom edge 28, a first lateral edge 30 and a second lateral edge 32. The portal aperture 22 is positioned nearer to a bottom side 34 than a top side 36 of the door 12.

A panel 38 is pivotably attached to the perimeter edge 24 and is positionable in an open condition 40 exposing the portal aperture 22 or in a closed condition 42 covering the portal aperture 22. The panel 38 has an inner surface 44 facing the portal aperture 22. A sealing flange 46 is positioned on the inner surface 44 and is positioned adjacent to an outer edge 48 of the panel 38. The sealing flange 46 engages the perimeter edge 24 when the panel 38 is in the closed condition 42. A pair of lateral walls 50 is attached to and extends between the panel 38 and the door 12. The lateral walls 50 each has a collapsible construction such that each of the lateral walls 50 collapses when the panel 38 is in the closed condition 42. A curtain 52 is attached to and extends downwardly from the top edge 26. The curtain 52 covers the portal aperture 22. The curtain 52 provides a penetrable barrier through the portal aperture 22. The curtain 52 comprises a plurality of vertically oriented slats 54. Each of the slats 54 is comprised of a resiliently bendable material. The resiliently bendable material may include a type of plastic, cloth, or metal.

A driver mechanism 56 is mounted on the door 12 and actuates the panel 38 between the open condition 40 and the closed condition 42. The driver mechanism 56 has a first element 58 which is mounted to the door 12, and a second element 60 which is mounted to the panel 38. The driver mechanism 56 moves the panel 38 alternatingly between the open condition 40 and the closed condition 42. The driver mechanism 56 can move the second element 60 away from the first element 58 by any conventional electromechanical system. Suitable electromechanical systems such as those using solenoids, stepper motors, servomotors, or pneumatic arms may be applied to move the panel 38 between the open condition 40 and the closed condition 42.

A locking mechanism 62 is attached to and releasably locks the panel 38 in the closed condition 42. The locking mechanism 62 is actuated to either an unlocked condition 64 which allows the panel 38 to be moved to the open condition 40, or a locked condition 66 restraining the panel 38 in the closed condition 42. The locking mechanism 62 includes a first locking component 68 which is mounted on the door 12, and a second locking component 70 which is mounted on the panel 38. The second locking component 70 is positioned to mate with the first locking component 68 when the panel 38 is in the closed condition 42. The locking mechanism 62 may use any sufficient method capable of being engaged by an electronic signal to releasably lock the panel 38 in the closed condition 42. Electromagnetic locks may be used to secure the panel 38 to the door 12 at contact points designated by the locking mechanism 62. Electromechanical systems such as those using solenoids, stepper motors, or servomotors to secure a pin, a tongue, or any other mechanical feature within a housing may be applied to secure the panel 38 to the door 12.

A control 72 is mounted on the door 12 and is in communication with the locking mechanism 62 and the driver mechanism 56. The control 72 actuates the locking mechanism 62 to the unlocked condition 64 and the panel 38 is moved to the open condition 40 when the control 72 receives an unlock input. The control 72 moves the panel 38 to the closed condition 42 and the locking mechanism 62 is actuated to the locked condition 66 when the control 72 receives a lock input.

An interface 74 is electrically coupled to the control 72. The interface 74 is actuated to send the unlock input and the lock input to the control 72. The interface 74 includes a processor 76. A power supply 78 is electrically coupled to the processor 76. A transceiver 80 is electrically coupled to the processor 76. The transceiver 80 is configured to receive and send wireless signals 82 with wireless communication devices 84. The interface 74 sends the unlock input to the control 72 when the transceiver 80 receives an unlock signal 82A from a wireless communications device 84. The interface 74 sends the lock input to the control 72 when the transceiver 80 receives a lock signal 82B from a wireless communications device 84 or after the panel 38 has been in the open condition 40 for a predetermined amount of time. The predetermined amount of time is a duration less than five minutes to prevent prolonged access through the door 12 in the instance the lock signal 82B is not sent or received The transceiver 80 is configured to send a verification signal 82C to the wireless communication device 84 when the panel 38 has moved from the open condition 40 to the closed condition 42 and the locking mechanism 62 has actuated to the locked condition 66 after the control 72 has received the lock input.

A camera 86 is mounted on the door 12 and is directed outwardly away from the dwelling wall 20. The camera 86 is in communication with the processor 76. The camera 86 is configured to capture video of an area adjacent to the door 12 such that the transceiver 80 can send the video to the wireless communication device 84.

A microphone 88 is mounted on the door 12 and is in communication with the processor 76. The microphone 88 is configured to capture recorded sound of the area adjacent to the door 12 such that the transceiver 80 can send the recorded sound to the wireless communication device 84. A speaker 90 is mounted on the door 12 and is in communication with the processor 76. The speaker 90 is configured to receive sound signals from the transceiver 80 and emit sound in the area adjacent to the door 12. The microphone 88 and the speaker 90 allow communication between one person positioned adjacent to the exterior surface 16 and another person using the wireless communication device 84.

A monitor 92 is mounted on the exterior surface 16 of the door 12 and is electrically coupled to the processor 76. The monitor 92 is configured to display an image from the wireless communication device 84. The monitor 92 is configured to display verification information to authenticate that a user of the wireless communication device 84 is permitted to accept and then has accepted the delivery. The verification information can include an image of the person using the wireless communication device 84, types of scannable codes, identification codes, and passwords to convey proper delivery. Scannable codes can include two-dimensional data matrix codes and traditional barcodes.

A doorbell 94 is in communication with the processor 76. The transceiver 80 is configured to send a notification signal 82D to the wireless communication device 84 when the doorbell 94 is actuated. The user of the wireless communication device 84 can selectively turn on the camera 86, microphone 88, speaker 90 and monitor 92 with the wireless communication device 84.

A plurality of support members 96 is rotatably coupled to the inner surface 44 and is configured to facilitate movement of a package across the inner surface 44 and through the portal aperture 22. The support members 96 include mechanical methods for facilitating movement in a linear direction, such as aligned rolling cylinders, aligned wheels, and disposed ball bearing sliders.

In use, the doorbell 94 is actuated which induces the transceiver 80 to send the notification signal 82D to the wireless communication device 84. The user can selectively use the camera 86, microphone 88, speaker 90, and monitor 92 to verify the delivery. The wireless communication device 84 sends the unlock signal 82A to the transceiver 80 which notifies processor the 76 which notifies the interface 74 to send the unlock input to the control 72. The control 72 sends the unlock signal to the locking mechanism 62 and the driver mechanism 56. The locking mechanism 62 actuates the unlocked condition 64 and the driver mechanism 56 then actuates the open condition 40 which moves the panel 38 away from the door 12 and allows access through the portal aperture 22.

After delivery the wireless communication device sends the lock signal 82B to the transceiver 80 which notifies the processor 76 which notifies the interface 74 to send the lock input to the control 72. The control 72 sends the lock signal to the locking mechanism 62 and the driver mechanism 56. The driver mechanism 56 actuates the closed condition 42 which moves the panel 38 to cover the portal aperture 22. The locking mechanism 62 then actuates the locked condition 66 to secure the panel 38 in the closed condition 42. The transceiver 84 sends a verification signal 82C to the wireless communication device 84 to alert the user that the locked condition 66 has been actuated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A secured parcel delivery system for permitting limited access through a door, said system including:

a door having an exterior surface, an interior surface, and a perimeter wall extending between said exterior surface and said interior surface, said door being mounted in a dwelling wall, said door having a portal aperture extending therethrough, said portal aperture including a perimeter edge having a top edge, a bottom edge, a first lateral edge and a second lateral edge;

a panel being pivotably attached to said perimeter edge and being positionable in an open condition exposing said portal aperture or in a closed condition covering said portal aperture;

a driver mechanism being mounted on said door and actuating said panel between said open condition and said closed condition, said driver mechanism having a first element being mounted to said door and a second element being mounted to said panel, said driver mechanism moving said panel alternatingly between said open condition and said closed condition;

a locking mechanism being attached to and releasably locking said panel in said closed condition, said locking mechanism being actuated to an unlocked condition allowing said panel to be moved to said open condition or a locked condition restraining said panel in said closed condition, said locking mechanism including:

a first locking component being mounted on said door;

a second locking component being mounted on said panel and positioned to mate with said first locking component when said panel is in said closed condition; and wherein a curtain is attached to and extends downwardly from said top edge, said curtain covers said portal aperture.

2. The system for permitting limited access through a door according to claim 1, wherein said portal aperture is positioned nearer to a bottom side than a top side of said door.

3. The system for permitting limited access through a door according to claim 1, wherein said panel has an inner surface facing said portal aperture.

4. The system for permitting limited access through a door according to claim 3, wherein a sealing flange is positioned on said inner surface and is positioned adjacent to an outer edge of said panel, said sealing flange engages said perimeter edge when said panel is in said closed condition.

5. The system for permitting limited access through a door according to claim 3, wherein a plurality of support members is rotatably coupled to said inner surface and is configured to facilitate movement of a package across said inner surface and through said portal aperture.

6. The system for permitting limited access through a door according to claim 1, wherein a pair of lateral walls is attached to and extends between said panel and said door.

7. The system for permitting limited access through a door according to claim 1, wherein said curtain provides a penetrable barrier through said portal aperture.

8. The system for permitting limited access through a door according to claim 1, wherein said curtain comprises a plurality of vertically oriented slats, each of said slats comprises a resiliently bendable material.

9. The system for permitting limited access through a door according to claim 1, wherein a control is mounted on said door and is in communication with said locking mechanism and said driver mechanism, said control actuates said locking mechanism to said unlocked condition and said panel is moved to said open condition when said control receives an unlock input, said control moves said panel to said closed condition and said locking mechanism is actuated to said locked condition when said control receives a lock input.

10. The system for permitting limited access through a door according to claim 9, wherein an interface is electrically coupled to said control, said interface is actuated to send said unlock input and said lock input to said control.

11. A secured parcel delivery system for permitting limited access through a door, said system including:

a door having an exterior surface, an interior surface, and a perimeter wall extending between said exterior surface and said interior surface, said door being mounted in a dwelling wall, said door having a portal aperture extending therethrough, said portal aperture including a perimeter edge having a top edge, a bottom edge, a first lateral edge and a second lateral edge;

a panel being pivotably attached to said perimeter edge and being positionable in an open condition exposing said portal aperture or in a closed condition covering said portal aperture;

a driver mechanism being mounted on said door and actuating said panel between said open condition and said closed condition, said driver mechanism having a first element being mounted to said door and a second element being mounted to said panel said driver mechanism moving said panel alternatingly between said open condition and said closed condition a locking mechanism being attached to and releasably locking said panel in said closed condition, said locking mechanism being actuated to an unlocked condition allowing said panel to be moved to said open condition or a locked condition restraining said panel in said closed condition, said locking mechanism including:

a first locking component being mounted on said door;

a second locking component being mounted on said panel and positioned to mate with said first locking component when said panel is in said closed condition; and wherein a pair of lateral walls is attached to and extends between said panel and said door, wherein each of said lateral walls has a collapsible construction such that each of said lateral walls collapses when said panel is in said closed condition.

12. The system for permitting limited access through a door according to claim 1, said system further comprising:

said portal aperture being positioned nearer to a bottom side than a top side of said door;

said panel having an inner surface facing said portal aperture, a sealing flange being positioned on said inner surface and being positioned adjacent to an outer edge of said panel, said sealing flange engaging said perimeter edge when said panel is in said closed condition;

a pair of lateral walls being attached to and extending between said panel and said door, said lateral walls each having a collapsible construction such that each of said lateral walls collapses when said panel is in said closed condition;

said curtain providing a penetrable barrier through said portal aperture, said curtain comprising a plurality of vertically oriented slats, each of said slats comprising a resiliently bendable material;

a control being mounted on said door and being in communication with said locking mechanism and said driver mechanism, said control actuating said locking mechanism to said unlocked condition and said panel is moved to said open condition when said control receives an unlock input, said control moving said panel to said closed condition and said locking mechanism is actuated to said locked condition when said control receives a lock input;

an interface being electrically coupled to said control, said interface being actuated to send said unlock input and said lock input to said control, said interface including:

a processor;

a power supply being electrically coupled to said processor;

a transceiver being electrically coupled to said processor, said transceiver being configured to receive and send wireless signals with wireless communication devices, said interface sending said unlock input to said control when said transceiver receives an unlock signal from a wireless communications device, said interface sending said lock input to said control when said transceiver receives a lock signal form a wireless communications device or after said panel has been in said open condition for a predetermined amount of time, said transceiver being configured to send a verification signal to the wireless communication device when said panel has moved from said open condition to said closed condition and said locking mechanism has actuated to said locked condition after said control has received said lock input;

a camera being mounted on said door and being directed outwardly away from said dwelling wall, said camera being in communication with said processor, said camera being configured to capture video of an area adjacent to said door such that said transceiver can send said video to the wireless communication device;

a microphone being mounted on said door and being in communication with said processor, said microphone being configured to capture recorded sound of the area adjacent to said door such that said transceiver can send said recorded sound to the wireless communication device;

a speaker being mounted on said door and being in communication with said processor, said speaker being configured to receive sound signals from said transceiver and emit sound in the area adjacent to said door, wherein said microphone and said speaker allow communication between one person positioned adjacent to said exterior surface and another person using die wireless communication device;

a monitor being mounted on said exterior surface of said door and being electrically coupled to said processor, said monitor being configured to display an image from the wireless communication device;

a doorbell being in communication with said processor, said transceiver being configured to send a notification signal to the wireless communication device when said doorbell is actuated, wherein a user of the wireless communication device can selectively turn on said camera, microphone, speaker and monitor with the wireless communication device; and a plurality of support members being rotatably coupled to said inner surface and being configured to facilitate movement of a package across said inner surface and through said portal aperture.

13. A secured parcel delivery system for permitting limited access through a door, said system including:

a door having an exterior surface, an interior surface, and a perimeter wall extending between said exterior surface and said interior surface, said door being mounted in a dwelling wall, said door having a portal aperture extending therethrough, said portal aperture including a perimeter edge having a top edge, a bottom edge, a first lateral edge and a second lateral a panel being pivotably attached to said perimeter edge and being positionable in an open condition exposing said portal aperture or in a closed condition covering said portal aperture;

a driver mechanism being mounted on said door and actuating said panel between said open condition and said closed condition, said driver mechanism having a first element being mounted to said door and a second element being mounted to said panel, said driver mechanism moving said panel alternatingly between said open condition and said closed condition;

a locking mechanism being attached to and releasable locking said panel in said closed condition, said locking mechanism being actuated to an unlocked condition allowing said panel to be moved to said open condition or a locked condition restraining said panel in said closed condition, said locking mechanism including:

a first locking component being mounted on said door;

a second locking component being mounted on said panel and positioned to mate with said first locking component when said panel is in said closed condition;

wherein a control is mounted on said door and is in communication with said locking mechanism and said driver mechanism, said control actuates said locking mechanism to said unlocked condition and said panel is moved to said open condition when said control receives an unlock input, said control moves said panel to said closed condition and said locking mechanism is actuated to said locked condition when said control receives a lock input;

wherein an interface is electrically coupled to said control, said interface is actuated to send said unlock input and said lock input to said control;

wherein said interface includes:

a processor;

a power supply being electrically coupled to said processor;

a transceiver being electrically coupled to said processor, said transceiver is configured to receive and send wireless signals with wireless communication devices;

a camera being mounted on said door and being directed outwardly away from said dwelling wall, said camera being in communication with said processor;

a microphone being mounted on said door and being in communication with said processor;

a speaker being mounted on said door and being in communication with said processor;

a monitor being mounted on said exterior surface of said door and being electrically coupled to said processor, said monitor being configured to display an image from the wireless communication device;

a doorbell being in communication with said processor, said transceiver is configured to send a notification signal to the wireless communication device when said doorbell is actuated, wherein a user of the wireless communication device can selectively turn on said camera, microphone, speaker and monitor with the wireless communication device.

14. The system for permitting limited access through a door according to claim 13, wherein said interface sends said unlock input to said control when said transceiver receives an unlock signal from a wireless communications device, said interface sends said lock input to said control when said transceiver receives a lack signal from a wireless communications device or after said panel has been in said open condition for a predetermined amount of time.

15. The system for permitting limited access through a door according to claim 14, wherein said transceiver is configured to send a verification signal to the wireless communication device when said panel has moved from said open condition to said closed condition and said locking mechanism has actuated to said locked condition after said control has received said lock input.

16. The system for permitting limited access through a door according to claim 13, wherein said camera is configured to capture video of an area adjacent to said door such that said transceiver can send said video to the wireless communication device.

17. The system for permitting limited access through a door according to claim 13, wherein said microphone is configured to capture recorded sound of the area adjacent to said door such that said transceiver can send said recorded sound to the wireless communication device.

18. The system for permitting limited access through a door according to claim 17, wherein said speaker is configured to receive sound signals from said transceiver and emit sound in the area adjacent to said door, wherein said microphone and said speaker allow communication between one person positioned adjacent to said exterior surface and another person using the wireless communication device.

19. The system for permitting limited access through a door according to claim 13, wherein said speaker is configured to receive sound signals from said transceiver and emit sound in the area adjacent to said door.

* * * * *